United States Patent [19]

Hirosawa

[11] 4,393,607

[45] Jul. 19, 1983

[54] HYDRAULIC EXCAVATOR

[75] Inventor: Katsu Hirosawa, Komatsu, Japan

[73] Assignee: Kabushiki Kaisha Komatsu Seisakusho, Tokyo, Japan

[21] Appl. No.: 314,516

[22] Filed: Oct. 23, 1981

[51] Int. Cl.[3] ..... E02F 5/22

[52] U.S. Cl. ..... 37/103; 414/687

[58] Field of Search ..... 37/103, 117.5, 118; 414/684–687, 722

[56] References Cited

U.S. PATENT DOCUMENTS

| | | | |
|---|---|---|---|
| 3,576,268 | 4/1971 | Suverkrop | 37/103 X |
| 3,703,973 | 11/1972 | Nilsson | 37/103 X |
| 3,922,017 | 11/1975 | Cobb | 37/103 X |
| 4,293,269 | 10/1981 | Zook | 414/686 |

FOREIGN PATENT DOCUMENTS

| | | | |
|---|---|---|---|
| 6705312 | 10/1967 | Netherlands | 37/103 |
| 616368 | 7/1978 | U.S.S.R. | 37/103 |

*Primary Examiner*—E. H. Eickholt

*Attorney, Agent, or Firm*—Armstrong, Nikaido, Marmelstein & Kubovcik

[57] ABSTRACT

A hydraulic excavator having first and second booms pivoted end to end, plus an arm pivotally connected to a swinging end of the second boom. A bucket is pivotally mounted at the leading end of the arm. A boom operating linkage mechanism including a lever and hydraulic cylinders is mounted on a full-revolving base for swinging the first boom with respect to the base. The arm is adapted to rotate with respect to the second boom and therefore the bucket is capable of providing both back hoe and front loading operations.

3 Claims, 10 Drawing Figures

HYDRAULIC EXCAVATOR

BACKGROUND OF THE INVENTION

This invention relates to a hydraulic excavator.

In general, in earth moving vehicles called hydraulic excavators, the implement attached boom-arm linkage adapted to operate an implement such as a bucket etc. has a long reach. Therefore, it has been a normal practice for such a vehicle to keep it stationarily to ensure the stability thereof during its earth moving work.

For this reason, vehicles of the type specified are not adapted to carry out satisfactorily operations requiring running, for example, transporting and running operations with the earth and sand loaded in the bucket thereof. Further, it is difficult for such vehicles to self-propel under a stable condition on inclined lands.

Besides, the implement attached boom-arm linkage having a long reach requires increasing the overall length of the vehicle, and therefore the vehicles of the type specified are inconvenient from the viewpoint of transportation thereof.

Further, in order to employ the vehicles of such a type for multi-purposes, replacements of their buckets for converting back hoe operation into front loading operation and vice versa have been made. However, such replacements of buckets have been conducted manually requiring a considerable time, and so it has been substantially impossible for the operator to carry out the replacement work rapidly.

SUMMARY OF THE INVENTION

It is therefore an object of the present invention to provide a hydraulic excavator having an implement attached boom-arm linkage which can be fully retracted and folded on a vehicle's base member thereby improving the stability of the vehicle when it travels and providing a good transportabilily thereof due to the compactness in size of the folded boom-arm linkage.

Another object of the present invention is to provide a hydraulic excavator which is versatile enough to provide both back hoe and front loading operations.

In accordance with an aspect of the present invention, there is provided a hydraulic excavator, comprising: a base; a first boom mounted on said base for movement in a vertical plane about a first pivot; a second boom mounted on said first boom for movement in the same vertical plane about a second pivot; an arm assembly mounted on said second boom for movement in the same vertical plane about a third pivot; an implement mounted at the swinging end of said arm assembly for movement about a fourth pivot; means for swinging said first boom with respect to said base about the first pivot, said means including a lever pivotally mounted on said base and first and second hydraulic cylinders; a third hydraulic cylinder for swinging said second boom with respect to said first boom about the second pivot; a fourth hydraulic cylinder for swinging said arm assembly with respect to said second boom about the third pivot; and a fifth hydraulic cylinder for swinging said implement with respect to said arm assembly about the fourth pivot.

Due to the unique two piece boom and an associated boom operating structures, the entire boom-arm linkage can be fully retracted and folded on a base member of the vehicle. The arm assembly has a built-in means for rotating a part of the assembly with respect to the second boom and therefore the implement such as a bucket can be rotated to provide both back hoe and front loading operations.

The above and other objects, features and advantages of the present invention will be readily apparent from the following description taken in conjunction with the accompanying drawings.

DESCRIPTION OF THE PREFERRED EMBODIMENTS

Figures 1, 2:
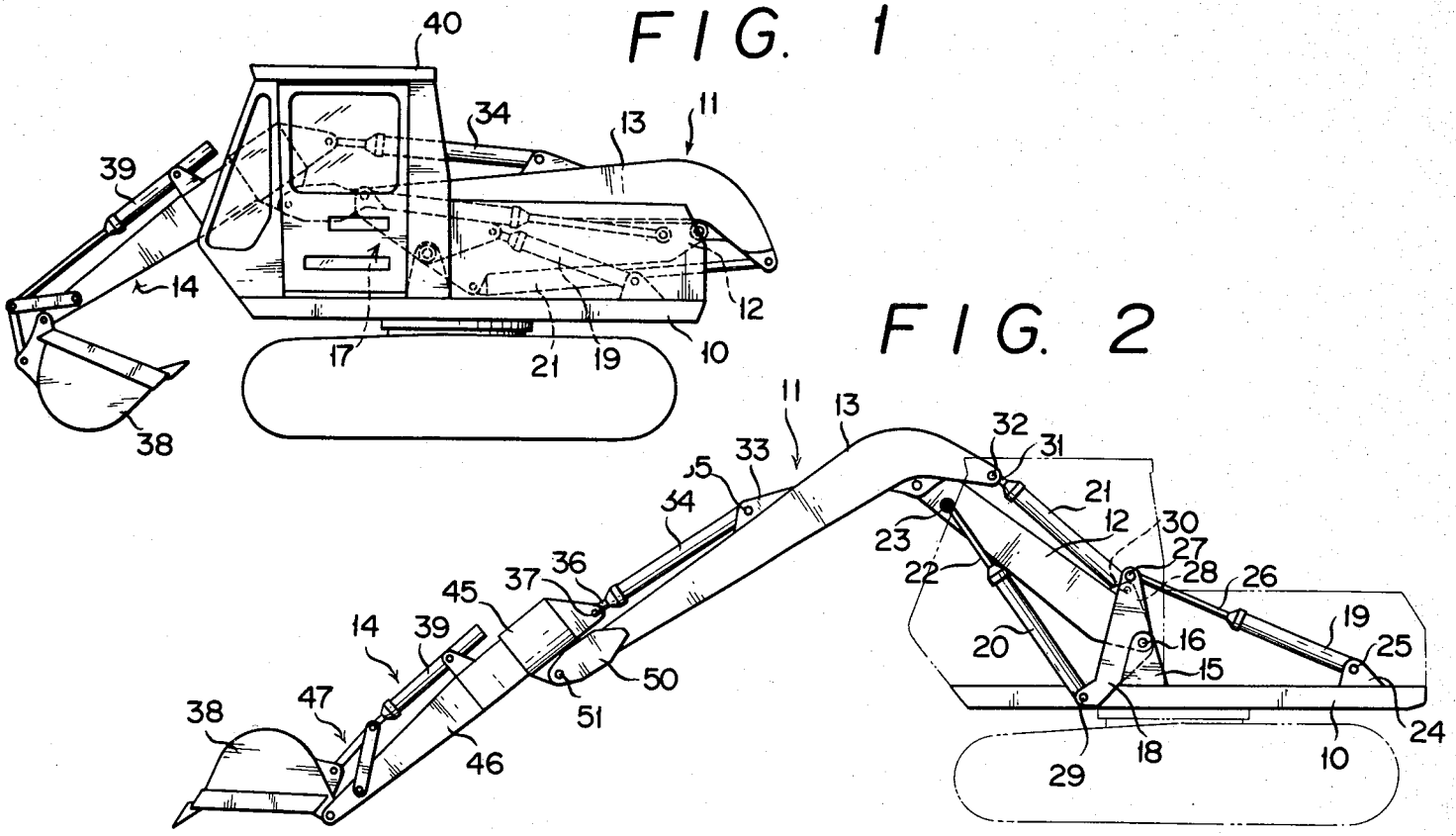
FIG. 1 is a side elevational view of a hydraulic excavator according to the present invention with a bucket attached boom-arm linkage being in fully retracted and folded position.
FIG. 2 is a side elevatinal view of a hydraulic excavator showing the bucket attached boom-arm linkage being in an extended position.

The present invention will now be described by way of example only with reference to the accompanying drawings.

Reference numeral 10 denotes a full-revolving base. The full-revolving base 10 has an implement attached boom-arm linkage 11. The implement attached boom-arm linkage 11 comprises a first or base boom 12, a second boom 13 and an arm assembly 14, all of the three components being articulated. The base boom 12 is pivotally connected at its base by means of a pin 16 to a pair of base brackets 15 mounted on the full-revolving base 10 and is adapted to be oscillated by means of a boom pivoting linkage mechanism 17 in the longitudinal direction of the vehicle.

The boom pivoting linkage mechanism 17 comprises a pair of levers 18 pivotally mounted on the same axis as that of the pin 16 pivotally connecting the base boom 12 to the pair of base brackets 15. Connected to the lower ends of the levers 18 by means of pins 29 are the base ends of a pair of second jacks 20 each having a rod 22 pivotally connected to the respective base booms 12 by means of a pin 23. The full-revolving base 10 has a pair of mounting brackets 24 fixedly secured thereto each of which is connected by means of a pin 25 to the base end of each first jacks 19. Each of the first jacks 19 has a rod 26 connected to the upper end of each lever 18 by means of a pin 27.

The base boom 12 has a mounting bracket 28 fixedly secured thereto and which is connected by means of a pin 30 to the base end of a second-boom operating cylinder 21. The second-boom operating cylinder 21 has a rod 31 which is connected by means of a pin 32 to the rear end of the second boom 13. The second boom 13 has a mounting bracket 33 fixedly secured thereto and which is connected by means of a pin 35 to the base end of an arm operating cylinder 34. The arm operating cylinder 34 has a rod 36 which is connected by means of a pin 37 to the rear end of the arm assembly 14. The second boom 13 has a pair of brackets 50 fixedly secured thereto and the arm assembly 14 is pivotally mounted by means of a pin 51 to the brackets 50.

The arm assembly 14 has a holder member 45 fitted to the base end thereof and on which the base end of an arm 46 is rotatably mounted and in which a hydraulic motor (not shown) adapted to rotate the arm 46 is accommodated. The arm 46 is operatively connected to the hydraulic motor by way of, for example, reduction gears. A bucket 38 is connected to the leading end of the arm 46 so that the bucket may be tilted by means of a bucket operating cylinder 39 mounted on the arm 46 through a linkage 47.

The implement attached boom-arm linkage 11 thus constructed is located on the longitudinal center line C of the vehicle body B. Located on the left and right sides of the implement attached boom-arm linkage 11 are a driver's cab 40 and a counter-weight 42 and a tank 41, all of which are mounted on the full-revolving base 10, such mounted equipments 40, 41 and 42 forming therebetween and in the central part of the vehicle body B an accommodating portion 44 in which the implement attached boom-arm linkage 11 is accommodated after being retracted and folded. The arrangements of the implement attached boom-arm linkage 11, the accommodating portion 44 and the mounted equipments are made such that when the boom-arm linkage 11 is retracted and folded in the accommodating portion 44 a major part of the boom-arm linkage is located within a locus circle S having a straight distance R between the center P of the vehicle body B and the front outer edge Q of the driver's cab 40 as the radius thereof.

The operation of the excavator according to the present invention will now be described hereinbelow. The first jacks 19 serve to oscillate or swing and hold the levers 18, whilst the second jacks 20 serve to oscillate and hold the base boom 12. Stating in brief, when the base boom 12 is held by means of the second jacks 20 and the levers 18 are oscillated by means of the first jacks 19, the base boom 12 is rotated together with the second jacks 20 about the pin 16. When the levers 18 are fixed by holding the first jacks 19 and the second jacks 20 are rendered operative, the base boom 12 can also be turned about the pin 16. Thus, both the first jacks 19 and the second jacks 20 serve to turn the base boom 12 about the pin 16.

Figure 3:
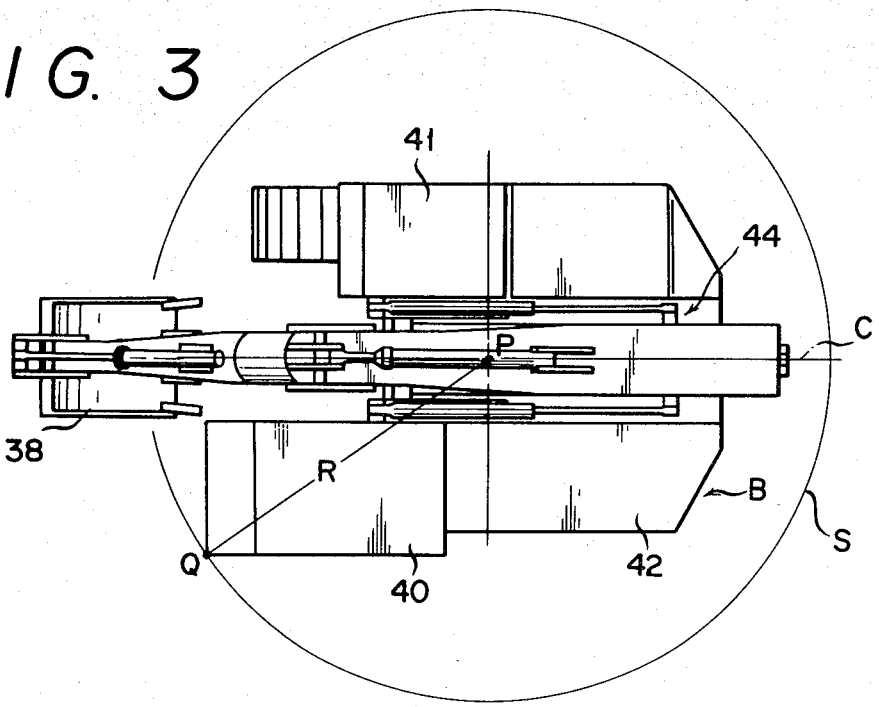
FIG. 3 is a schematic plan view of FIG. 1.
Figure 4:
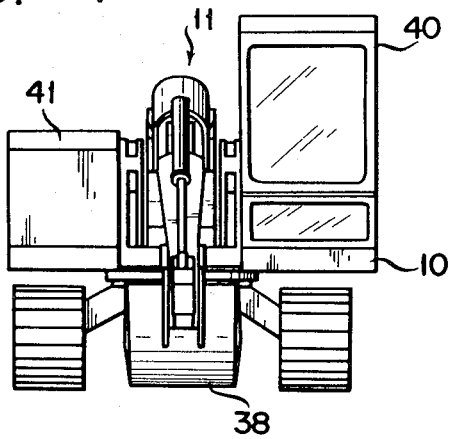
FIG. 4 is a front elevational view of FIG. 1.

The above-mentioned movement of the base boom 12 will carry or displace the second boom 13 longitudinally and vertically of the vehicle body B. When the base boom 12 is displaced rearwardly of the vehicle body B and then the rod 31 of the second-boom operating cylinder 21 is extended, the second boom 13 is retracted and folded on the base boom 12. (Refer to FIGS. 1 and 3). As shown in FIG. 3, under such condition, the greater part of the implement attached boom-arm linkage 11 is accommodated in the locus circle S. When, the second boom 13 is displaced forwardly of the vehicle body B and then moved vertically together with the movement of the arm 14, back hoe operation as shown in FIG. 2 is effected.

The above-mentioned arrangement enables the overall length and the overall height of the vehicle to be reduced or made compact and also enables a stability thereof during running to be obtained by drawing the implement attached boom-arm linkage 11 near the center of gravity of the vehicle.

Figure 5:
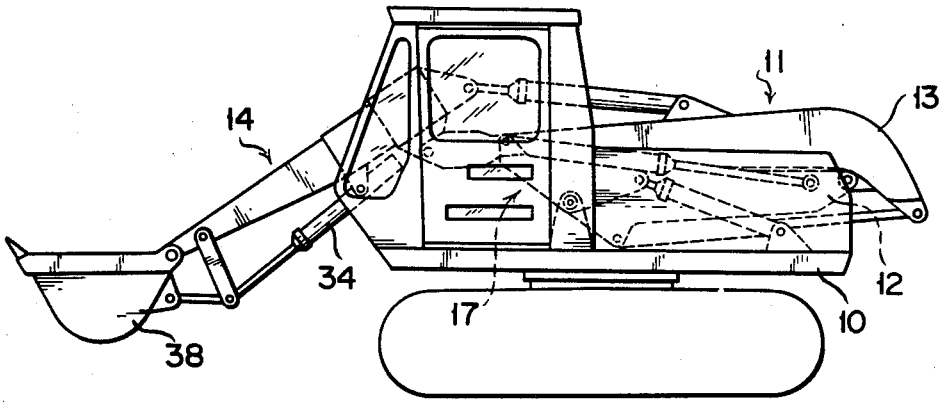
FIG. 5 is similar to FIG. 1 but showing the bucket being rotated and adapted to front loading operation.
Figure 6:
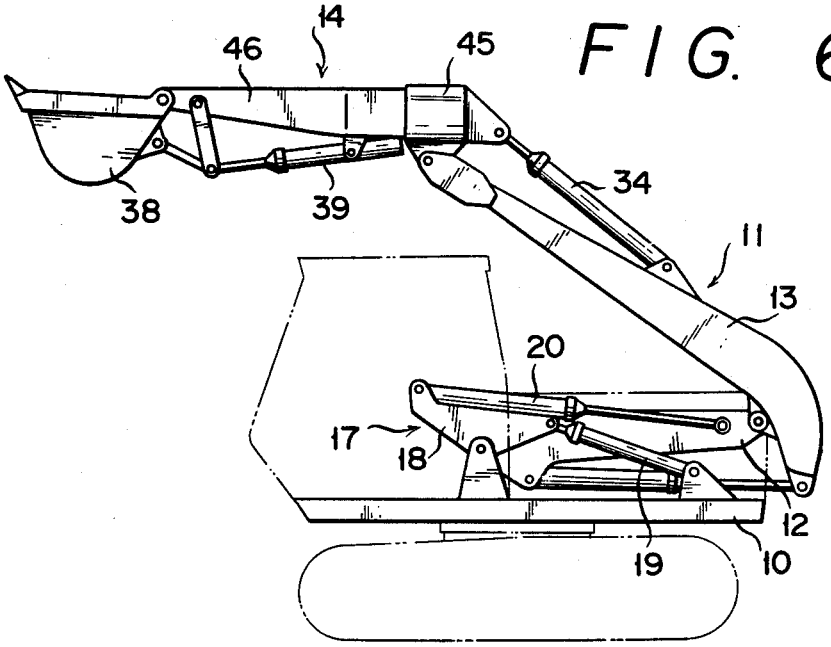
FIGS. 6 and 7 are side elevational views of the embodiment shown in FIG. 5 each showing how the bucket attached boom-arm linkage is operated.
Figure 7:
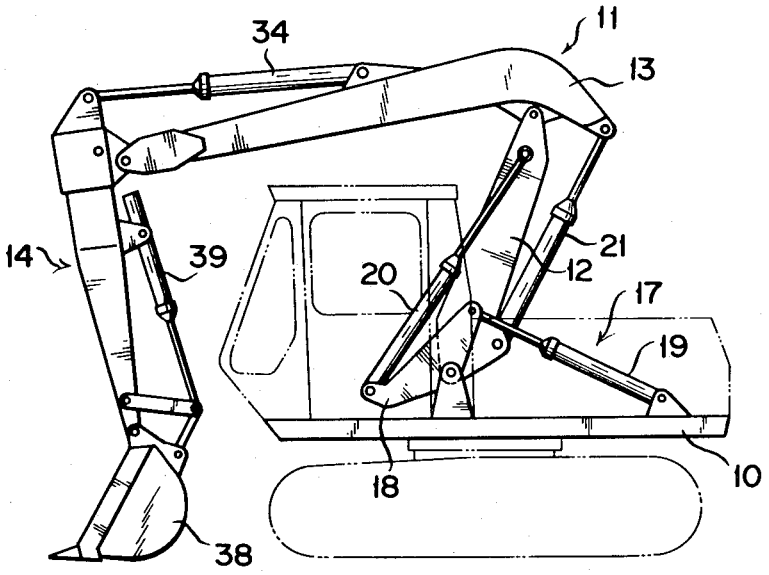

FIGS. 5, 6 and 7 show another mode of operation of the excavator according to the present invention in which a hydraulic motor in the arm assembly 14 is driven to turn the arm 46 thereby effecting front loading operation. As shown in FIG. 5, when the base boom 12 and the second boom 13 are retracted and folded in the accommodating portion 44, the booms 12 and 13 will not give a bad influence on the running posture of the vehicle thereby enabling the self-running of the vehicle with excavated earth loaded in the bucket 38 to be made satisfactorily.

FIG. 6 shows the bucket 38 raised to its dumping reach or height. FIG. 7 shows the excavator is under front loading operation wherein the opening of the bucket 38 is directed forwardly and the implement attached boom-arm linkage 11 is controlled to effect the front loading operation.

Figure 8:
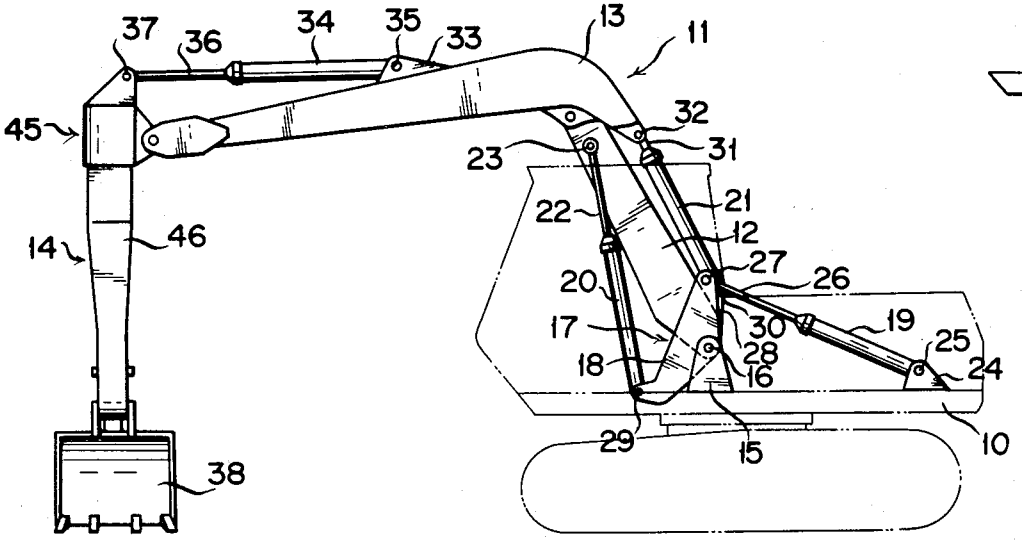
FIG. 8 is a side elevational view of a hydraulic excavator with the bucket being rotated for 90 degrees to face sideways.

When the arm 46 is turned to direct the opening of the bucket 38 transversely as shown in FIG. 8 and the full-revolving base 10 is rotated, it is pssible to scoop the earth and sand into the bucket 38, lay them evenly on the ground, readjust the land and remove the earth and sand.

Figure 9:
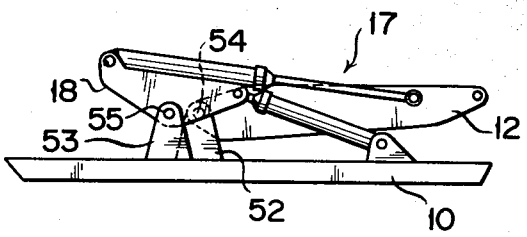
FIG. 9 is a side elevational view of another embodiment of a boom operating linkage mechanism.
Figure 10:
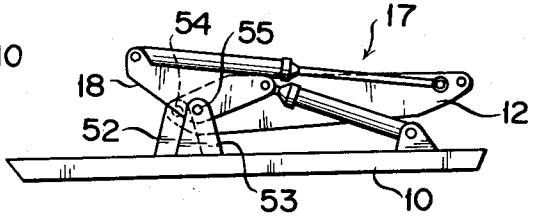
FIG. 10 is similar to FIG. 9 but showing still another embodiment of a boom operating linkage mechanism.

FIGS. 9 and 10 show further embodiments of the boom pivoting linkage mechanism 17 mountings to the full-revolving base 10. In brief, the levers 18 and the base boom 12 are connected by means of pins 54 and 55, respectively, to independent brackets pairs 54 and 55 projecting from the full-revolving base 10 and the respective pivots of the base boom 12 and the levers 18 are displaced longitudinally of the vehicle body.

As described in detail hereinabove, the present invention is characterized by comprising a base boom 12 mounted for a pivotal movement on a full-revolving base 10, a second boom 13 operatively connected to the base boom 12 and adapted to be raised and lowered by means of a boom operating cylinder 21, an arm assembly 14 operatively connected to the second boom 13 and arranged to rotate an arm 46 having a bucket 38 fitted to the leading end thereof, said arm assembly 14 being arranged to be raised and lowered by means of an arm cylinder 34, and a boom pivoting linkage mechanism 17 mounted on the full-revolving base 10 and adapted to raise and lower the base boom 12.

Therefore, the greater part of the implement attached boom-arm linkage can be folded and retracted on the side of the vehicle body so that the overall length and the overall height of the vehicle can be reduced thereby enabling an improved stability thereof when it is running to be obtained. In addition thereto, the base boom can be moved longitudinally of the vehicle body by oscillating it and the second boom can be displaced longitudinally and vertically of the vehicle body so that both booms can be freely displaced from its folded and retracted condition on the side of the vehicle body to its operating condition and vice versa. Further, even when a back hoe bucket is converted to a front loading operation bucket and vice versa, an operational capacity can be obtained which is equivalent to those of excavators exclusive to back hoe operation or to front loading operation. Further, since in the arm assembly 14 the arm 46 having the bucket 38 fitted thereto can be rotated, a switch-over between the back hoe operation and the front loading operation can be made rapidly and smoothly.

Although the present invention has been shown and described in terms of the preferred embodiment and modifications thereof, it is to be understood that a variety of other modifications and changes may be made without departing from the spirit of the invention as defined in the appended claims.

What is claimed is:

1. A hydraulic excavator comprising:

a base;

a first boom mounted on said base for movement in a vertical plane about a first pivot;

a second boom mounted on said first boom for movement in the same vertical plane about a second pivot;

an arm assembly mounted on said second boom for movement in the same vertical plane about a third pivot;

an implement mounted at the swinging end of said arm assembly for movement about a fourth pivot;

means for swinging said first boom with respect to said base about the first pivot, said means including a lever pivotally mounted on said base and first and second hydraulic cylinders, said lever having first and second ends and is pivoted about the first pivot, said first hydraulic cylinder having its one end pivotally connected to said base and the other end pivotally connected to the first end of said lever while said second hydraulic cylinder has its one end pivotally connected to the second end of said lever and the other end pivotally connected to said first boom;

a third hydraulic cylinder for swinging said second boom with respect to said first boom about the second pivot;

a fourth hydraulic cylinder for swinging said arm assembly with respect to said second boom about the third pivot; and a fifth hydraulic cylinder for swinging said implement with respect to said arm assembly about the fourth pivot.

2. A hydraulic excavator as recited in claim 1 wherein said lever is pivoted about a fifth pivot which is offset from the first pivot.

3. A hydraulic excavator as recited in claim 1 further comprising means including a motor for rotating said arm assembly with respect to said second boom thereby angularly changing the posture of said implement.

* * * * *